US005181623A

United States Patent [19]

Linden et al.

[11] Patent Number: 5,181,623

[45] Date of Patent: Jan. 26, 1993

[54] DISPLAY SHELF ADAPTER

[75] Inventors: Tom H. Linden, Yorba Linda; Dick Passaglia; Ray Taccolini, both of Villa Park, all of Calif.

[73] Assignee: Crown Bolt, Inc., Cerritos, Calif.

[21] Appl. No.: 809,051

[22] Filed: Dec. 17, 1991

[51] Int. Cl.[5] ..... A47F 5/00

[52] U.S. Cl. ..... 211/183; 211/59.2; 248/248

[58] Field of Search ..... 211/183, 59.2, 186, 211/187, 134; 248/241, 247, 248

[56] References Cited

U.S. PATENT DOCUMENTS

| | | | |
|---|---|---|---|
| 1,068,391 | 7/1913 | Jensen . | |
| 1,220,717 | 3/1917 | Bennett . | |
| 3,042,221 | 7/1962 | Rasmussen | 211/183 |
| 3,268,195 | 8/1966 | Hoffman | 248/247 X |
| 4,101,233 | 7/1978 | McConnell | 211/187 X |
| 4,203,175 | 5/1980 | Heine . | |
| 4,387,873 | 6/1983 | Pavlo et al. . | |
| 4,418,496 | 12/1983 | Koistinen . | |
| 4,684,095 | 8/1987 | Athey . | |
| 4,960,210 | 10/1990 | Sparner | 211/183 X |

FOREIGN PATENT DOCUMENTS

| | | | |
|---|---|---|---|
| 2177287 | 1/1987 | United Kingdom | 248/248 |

*Primary Examiner*—Robert W. Gibson, Jr.
*Attorney, Agent, or Firm*—Knobbe, Martens, Olson & Bear

[57] ABSTRACT

A shelf adaptor or bracket mounts on a shelving unit to support a shelf so it is angled downward from back to front, instead of being horizontal. Such an arrangement is useful for supporting and displaying certain goods and enables shelving to be readily adapted to two different modes.

13 Claims, 5 Drawing Sheets

DISPLAY SHELF ADAPTER

FIELD OF THE INVENTION

This invention relates to shelving, and more particularly to adaptors for display shelving.

BACKGROUND OF THE INVENTION

With recent marketing trends, it is becoming very popular for warehouse-type retail stores to sell a wide variety of items in bulk. This entails having a large container full of the loose product from which the customer selects the desired amount of the product.

Currently, the items are typically bought from the wholesaler in containers, and the retailer waits until a container currently on the display shelf is empty before replacing it with another full container. This can lead to certain disadvantages. If the container is sufficiently large, it can be awkward or difficult for the customer to not only see, but also to reach the last items in the container. This problem may necessitate that the retailer move these items nearer to the opening manually, wasting valuable employee time. There is thus a need for a way to move items toward the opening of the containers and to enable consumers to easily see into the containers.

The above mentioned problem is partially the result of the standardized shelving which is currently in common use in such retail stores. Such shelving is relatively inexpensive and convenient to use because of such standardization. However, a drawback is that such shelving is level from front to back. In many types of such shelving, each shelf rests upon a front crossbeam and a rear crossbeam, wherein each of the crossbeams is at substantially the same height, thus yielding a shelf which is substantially level.

Another drawback to the standardized shelving is that it typically has no convenient location where the retailer can post price and other information about the items displayed thereupon. There is thus a need for shelving which can provide such a price display position.

While several patents disclose devices which can be thought of as being composed of a bracket portion and a support portion, as in the instant invention, none disclose a device which contains all the features and advantages of the instant invention. The devices disclosed in Jensen U.S. Pat. No. 1,068,391 and Pavlo et. al. U.S. Pat. No. 4,387,873 both require multiple components to assemble. The devices disclosed in Bennett U.S. Pat. No. 1,220,717, Heine U.S. Pat. No. 4,203,175, Koistinen U.S. Pat. 4,418,496, Athey U.S. Pat. No. 4,684,095, and Jensen all involve hook-shaped support structures, and would thus not be appropriate for shelving which requires a support structure more nearly planar with each shelf. None of the patents cited above discloses a device of sufficient mechanical strength to support weight loads as great as does the instant invention.

SUMMARY OF THE INVENTION

In many types of standardized shelving, each shelf rests upon a front crossbeam and a rear crossbeam, wherein each of the crossbeams is at substantially the same height, yielding a shelf which is substantially level. The instant invention comprises an adaptor which fits over the front crossbeam of such standardized shelving and provides a support surface for the front edge of the shelf which is lower than that previously available on the front crossbeam. This creates a shelf which is not substantially level, but which is angled downward from back to front, toward the customer. This angling allows gravity to urge the loose items inside containers placed upon the shelf to slide to the front of the containers. In a preferred embodiment the adaptor creates a shelf angle of about 5 degrees, and is provided with two display surfaces suitable for price and content markers. Lowering the front beam is advantageous from a space standpoint in that the forward edge of the shelf is actually in the space directly between the front and rear cross beans, and such space is otherwise wasted.

BRIEF DESCRIPTION OF THE DRAWINGS

The present invention will be better understood from the description of the embodiment given below, taken in conjunction with the drawings in which like reference characters or numbers refer to like parts throughout the description, in which.

DETAILED DESCRIPTION OF THE PREFERRED EMBODIMENTS

Figure 1:
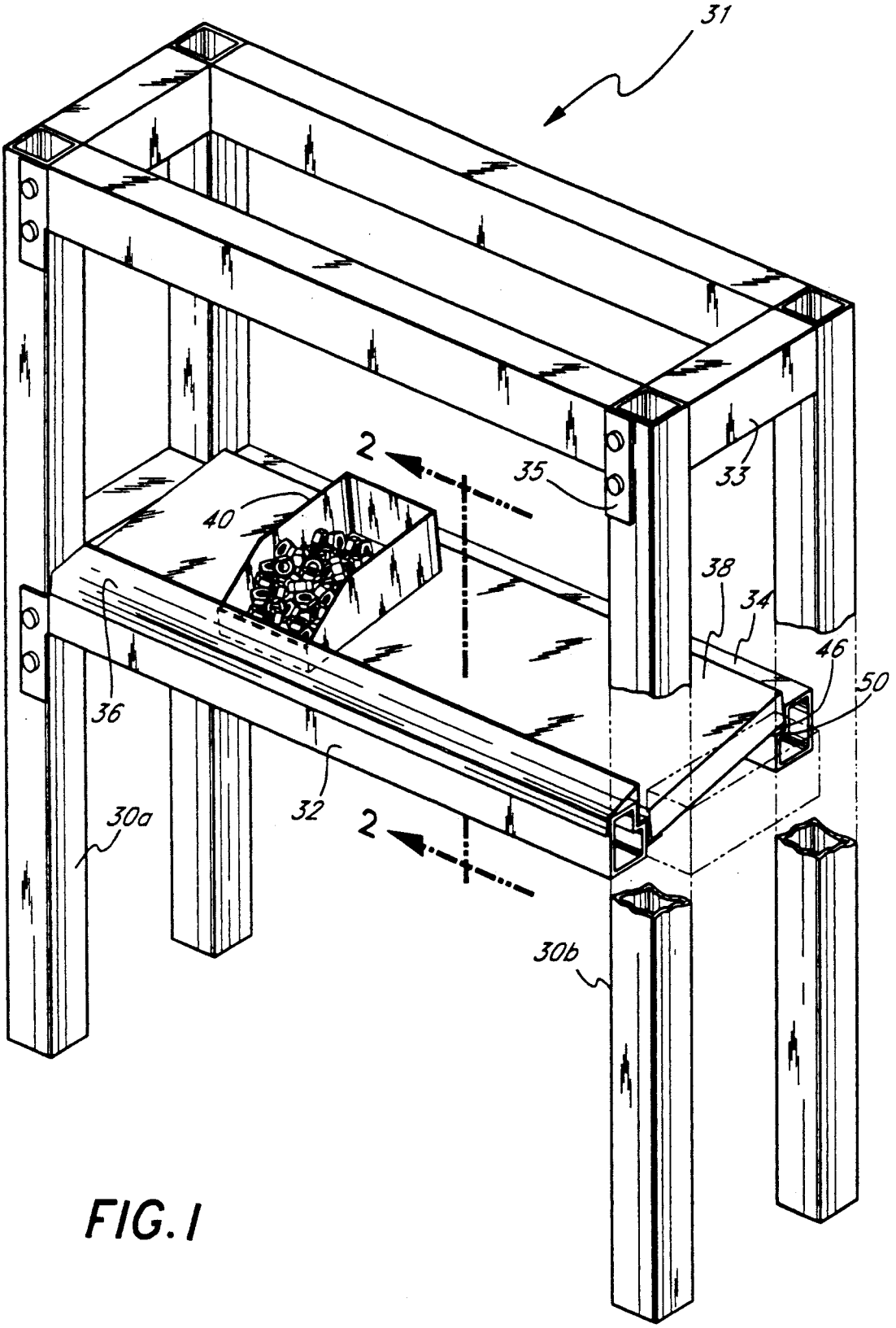
fig. 1 IS A perspective view of display shelving utilizing the display shelf adaptor.

FIG. 1 shows a simplified view of a standardized shelving unit 31 with a display shelf adaptor 36. The unit includes two pairs of uprights or posts 30*a* and 30*b*, joined by a front crossbeam 32 and a rear crossbeam 34, and by side beams 33. The beams and the posts may be composed of any suitably strong material, with steel being in most common use for supporting heavy items such as boxes of metal nuts, bolts, washers and other fasteners. The posts and the beams if made of steel, have a tubular cross section.

The posts and side beams are secured by any suitable means, not shown, such as fasteners extending through holes in the posts. The cross beams 32 and 34 have plates 35 on their ends which are secured by fasteners through the posts 30*a* and 30*b*. Although not shown the posts typically have a series of spaced mounting holes to permit adjustable mounting of the cross beams. In one common arrangement, the holes have a keyhole shape so that bolt like elements welded to the plates 35 fit within the upper ends of the holes and the beams are then lowered to a retained position. This permits easy adjustability.

Figure 2:
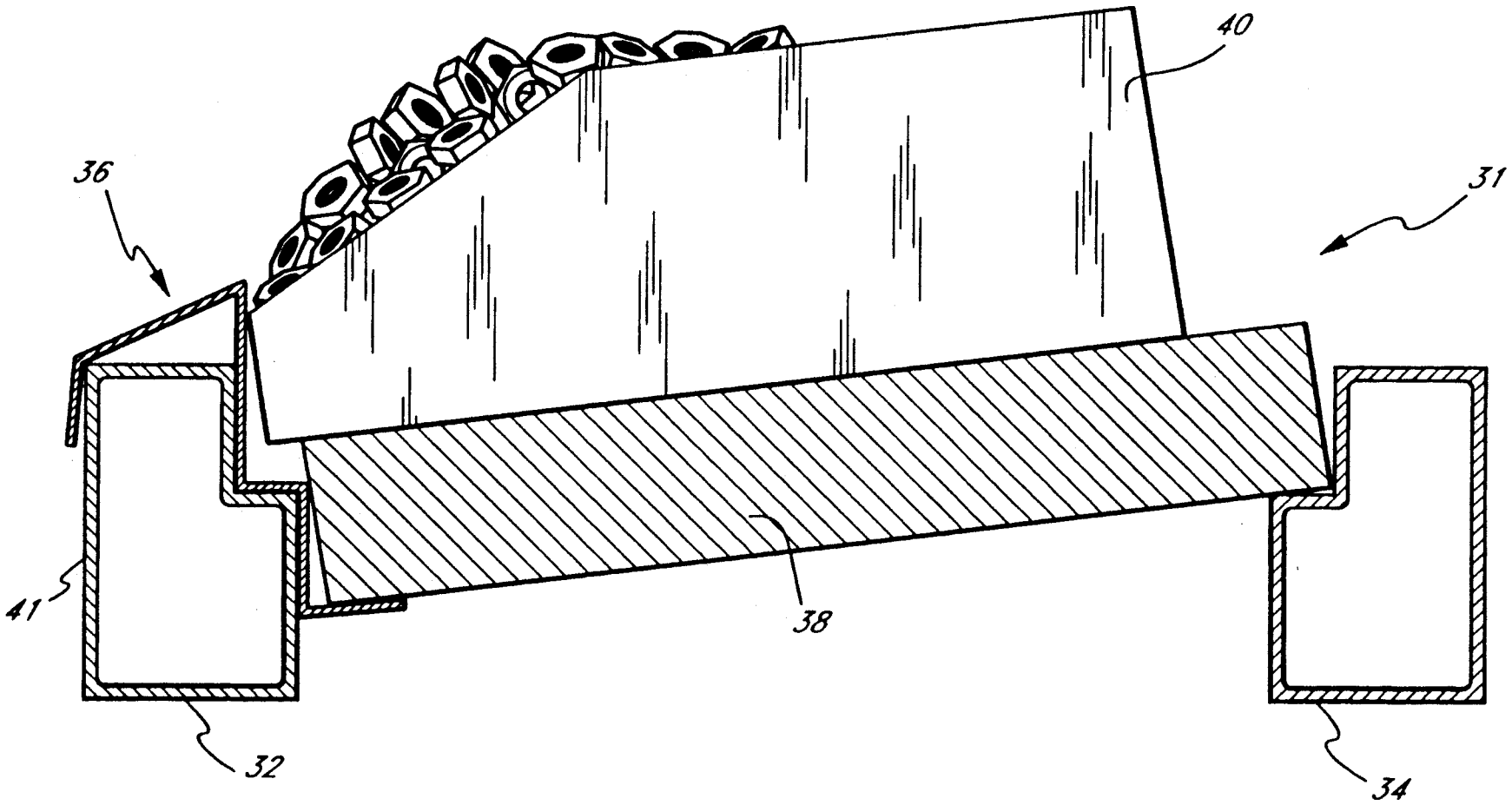
FIG. 2 is a cross-sectional view taken along line 2—2 of FIG. 1.

Referring also now to FIG. 2, the crossbeams have a generally rectangular cross section with a rectangular notch 46 in the upper corner that faces the other cross beam. The shelving unit 31 is completed by inserting a shelf 38 between the beams. Previously this was accomplished by placing the shelf 38 such that it rested upon a recessed horizontal surface 50 inside the notch 46 in both the front crossbeam 32 and the rear crossbeam 34, wherein the recessed horizontal surfaces 50 in both crossbeams 32 and 34 are at substantially the same height. The shelf 38 may consist of a single rectangular element or a series of boards laid side by side as depicted in FIG. 1. A 3×6 wood board is commonly used in shelving for threaded fasteners. Containers 40 can then be set upon the shelf for display and storage purposes.

Figure 3:
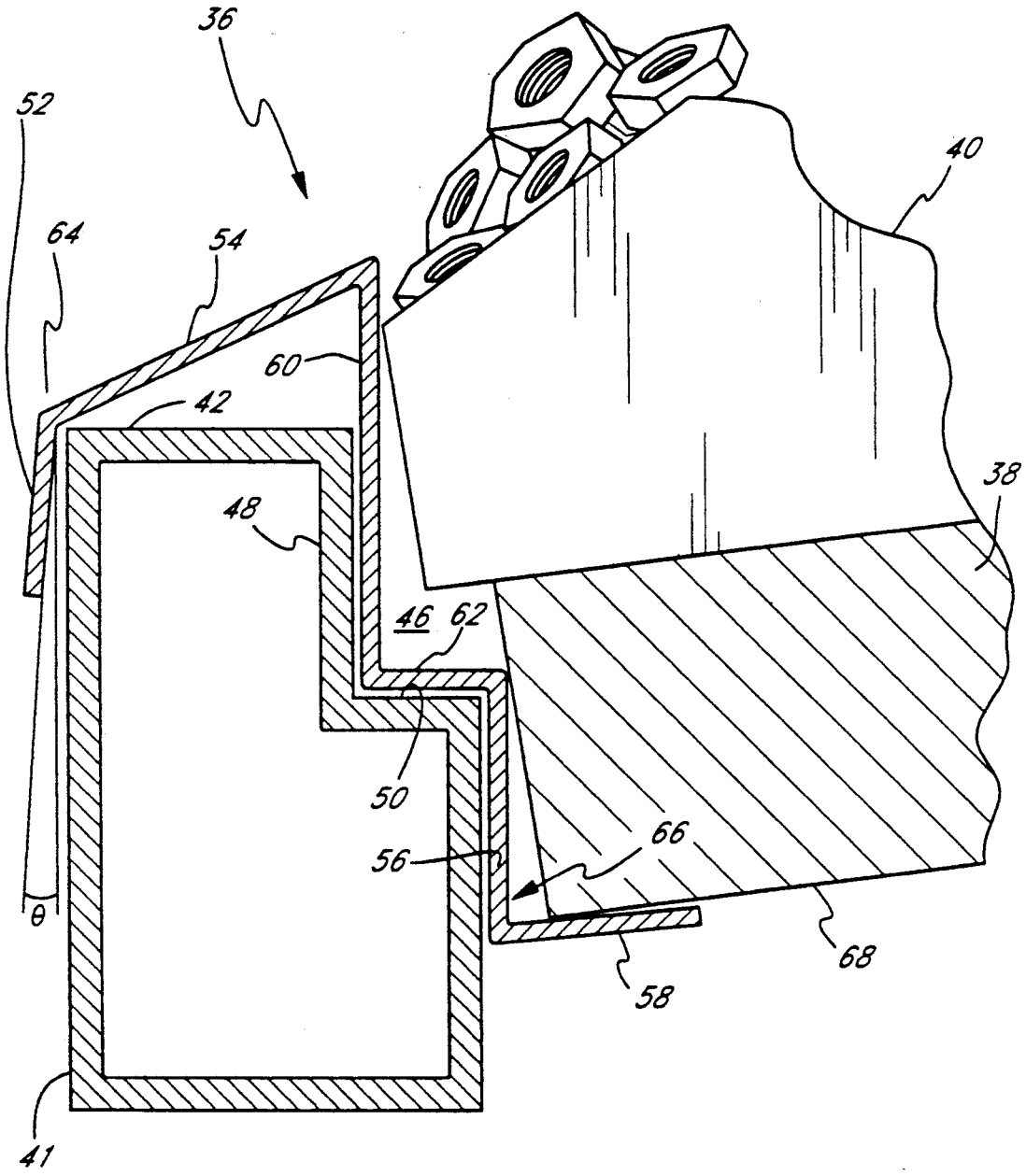
FIG. 3 is an enlarged view of a portion of FIG. 2.
Figure 4:
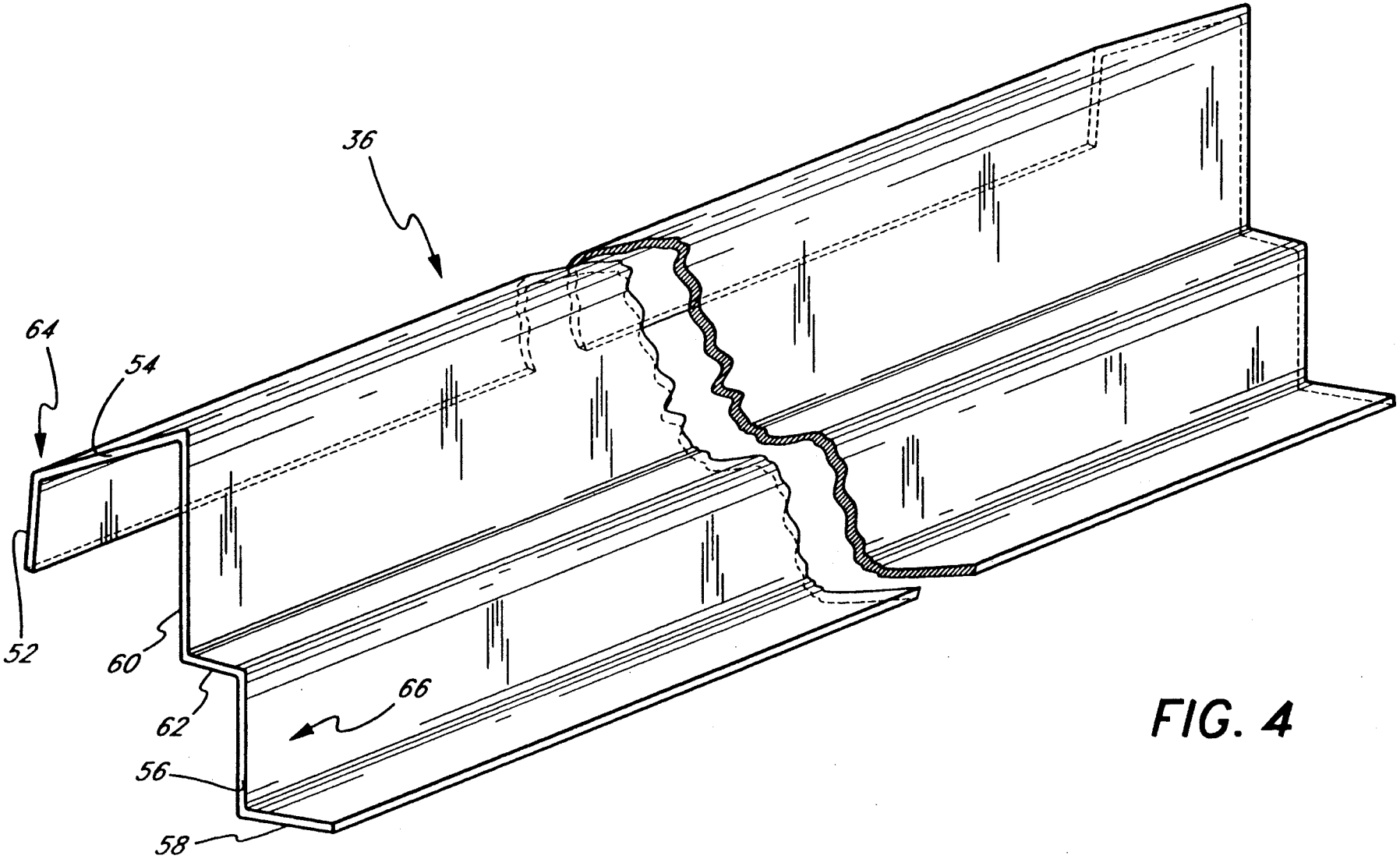
FIG. 4 is a perspective view of the display shelf adaptor.

Advantageously the adaptor 36 is integrally formed from a single sheet of metal. By integrally formed it is meant that the article is formed by bending a single sheet of a suitable material into the desired illustrated shape. Referring to FIGS. 3 and 4, the adaptor 36 preferably has six contiguous segments, a front segment 52, an upper segment 54, a recessed vertical segment 60, a recessed horizontal segment 62, a rear vertical segment 56, and a shelf supporting arm 58, in that order. These segments represent the six separate planar surfaces of the adaptor 36, each of which is separated from its neighboring segments by a bend in the metal from which the adaptor 36 is composed. The adaptor 36 can also be thought of as being composed of two portions, a bracket portion 64 which is formed by the front segment 52, the upper segment 54, the recessed vertical segment 60, and the recessed horizontal segment 62, and a shelf support portion 66 which is formed by the rear segment 56 and the shelf supporting arm 58. The top and bottom and front and back sides of the adaptor 36 will be referred to as pictured in FIG. 1, with the front segment 52 being on the front side and the upper segment 54 being on the top side.

Figure 5:
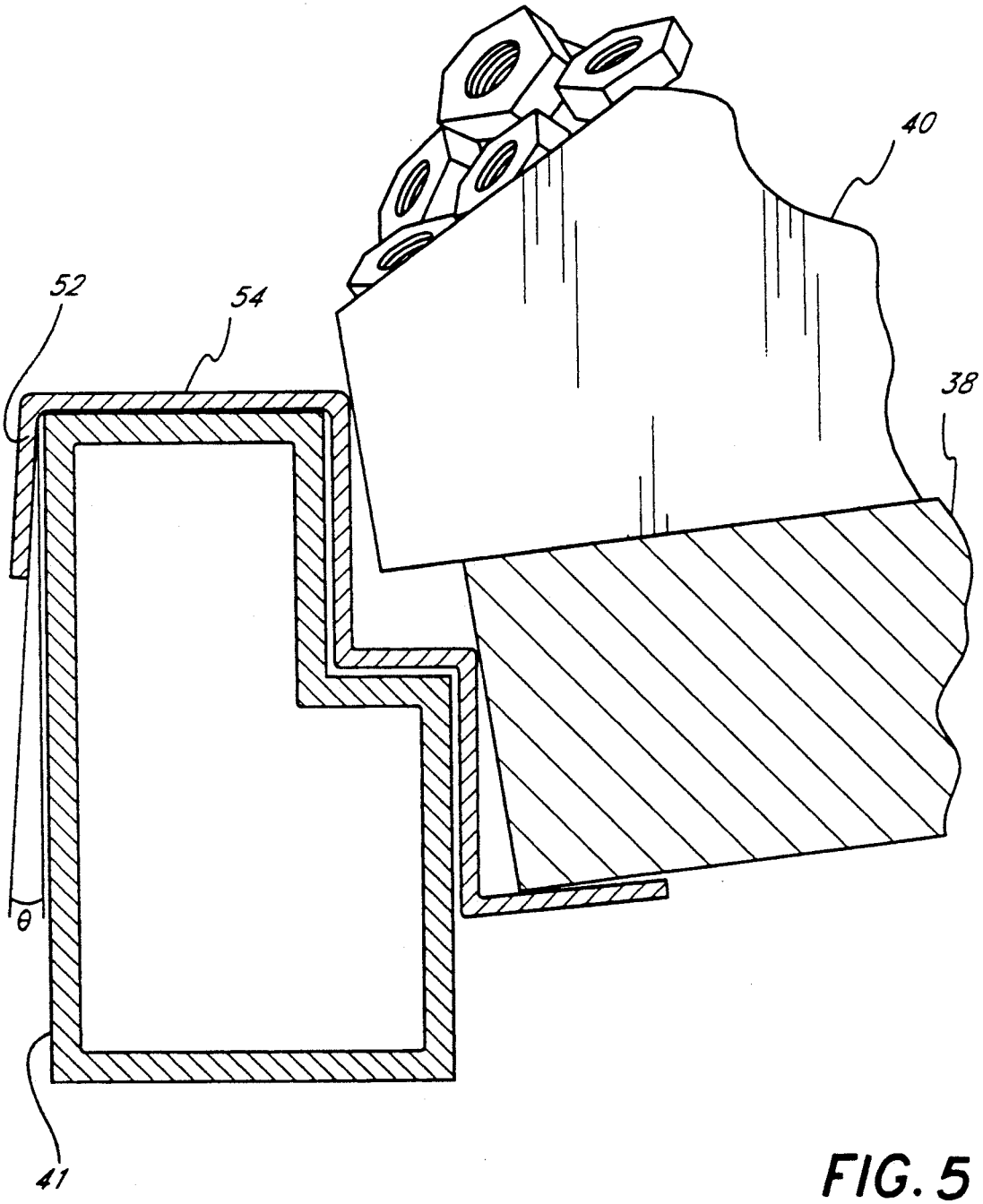
FIG. 5 is a cross-sectional view as in FIG. 3 of an alternative of the display shelf adaptor.

The front segment 52 may be substantially parallel to a front crossbeam surface 41, as in FIG. 5. In a preferred embodiment the front segment 52 is angled away from the front crossbeam surface 41 from top to bottom, as in FIGS. 2 and 3. Advantageously, the angle $\theta$ formed between the front segment 52 and the substantially vertical front crossbeam surface 41 is about 5 degrees. Having the front segment 52 angled in this manner facilitates placement of the adaptor 36 onto the front crossbeam 32, by creating a region between the front segment 52 and the recessed vertical segment 60 which is wider than an upper crossbeam surface 42. This wider region reduces the possibility of a given adaptor 36 not fitting over a given front crossbeam 32 because of excess variation in the manufacture of either component The front segment 52 is also useful as a display surface, and advantageously is the appropriate size to accommodate a store's informational labels.

The upper segment 54 may be made so as to be substantially parallel to the upper crossbeam surface 42, as in FIG. 5. Preferably, however, the upper segment 54 is angled away from the upper crossbeam surface 42 from front to back, as in FIG. 2. Front is meant to indicate nearer the customer when the adaptor 36 is in use, and back is meant to indicate away from the customer. In normal use, the front segment 52 will be in the front, and the shelf supporting arm 58 will be back of that. In the most preferred embodiment, the angle $\theta$ formed between the upper segment 54 and the substantially horizontal upper crossbeam surface 42 is about 25 degrees. Thus, the angle formed by the front segment 52 and the upper segment is preferably about 120°. Also, the angle formed by the upper segment and the vertical segment 60 is therefore preferably 65°. An advantage of angling the upper segment 54 in this manner is its increased utility as a display surface. Because a shelving unit 31 will have multiple shelves 38, some of these shelves 38 may be lower than eye-level, and others higher. By angling the upper segment 54, it becomes easier for the customer to view information displayed on the surface of the upper segment 54 at a wider variety of shelf heights. Advantageously, the upper segment 54 is of such a size as to be useful for the display of "CBI" size labels.

Angling the upper segment, also places the upper end of the segment 60 well above the crossbeam 32 to provide the stop for the box 70.

As can be seen, the segments 52, 54, and 60 form a downward opening, somewhat inverted U-shape that fits on the upper, notched portion of the front beam. The recessed vertical segment 60 holds the bracket portion in close contact with a recessed vertical surface 48 of the front crossbeam 32. This helps to ensure an adequate fit between the adaptor 36 and the front crossbeam 32, thereby supporting a shelf 38 which is mechanically stable. Advantageously, the recessed vertical segment 60 is of a proper length such that when the recessed horizontal segment 62 contacts the recessed horizontal surface 50, the upper segment 54 is also in contact with at least some portion of the upper crossbeam surface 42. If too short, the recessed horizontal segment 62 does not contact the recessed horizontal surface 50, and this will result in the condition of the upper segment 54 carrying a disproportionate amount of the weight load on the shelf 38. If too long, the recessed horizontal surface 50 will instead carry a disproportionate amount of the load.

The recessed horizontal segment 62 which is perpendicular to the segment 60, serves to a large extent, to support the adaptor 36 upon the front crossbeam 32. Much of the force created by the mass of the shelf 38 and its contents laying upon the shelf supporting arm 58 of the adaptor 36 is transferred to the front crossbeam 32 along the recessed horizontal segment 62. As seen, the depth of the recessed horizontal segment 62 is equal to the depth of the recessed horizontal surface 50 of the front crossbeam 32.

The rear segment 56, which is perpendicular to the segment 62 and parallel to the segment 60, determines the change in shelf elevation achieved by the adaptor 36. The longer or higher the rear segment 56, the lower is the front of the shelf 38 relative to its rear. In the preferred embodiment, the angle formed by shelf 38 and the horizontal is sufficient to allow gravity feeding of the merchandise inside the container 40 on shelf 38 to the front of the container 40. An angle of about 5 degrees is believed preferable for use with containers 40 of threaded fasteners and their components. Advantageously, the rear segment 56 will be substantially parallel to, and in substantial contact with, a rear crossbeam surface 44.

The shelf supporting arm 58 supports the front end of the shelf 38 at an elevation lower than the rear end of the same shelf 38. To achieve this, the shelf supporting arm 58 must be of sufficient mechanical strength to support the shelf 38 and any items placed thereupon without bending significantly and without breaking. Since the adaptor 36 is preferably integrally formed, the entire structure must be formed of a material sufficiently strong to perform under the stress conditions required of the shelf supporting arm 58. A sheet of 14 gauge steel is believed suitable for use on shelving to support boxes of metal fasteners. The angle $\delta$ formed between the shelf supporting arm 58 and the rear segment 56 is preferably the same as the angle formed by the shelf 38 and the adjacent wall of the crossbeam, namely about 85°. Thereby, a lower shelf surface 68 will be in close contact with the shelf supporting arm 58 along as wide a range as possible.

The display shelf adaptor 36 is placed onto the front crossbeam 32 prior to the placement of the shelf 38. This is accomplished by placing the adaptor 36 over the front crossbeam 32 as is demonstrated in FIGS. 2, 3, and 5. Thereafter, instead of placing the shelf 38 upon the recessed horizontal surface 50 of the front crossbeam 32, the shelf 38 is placed upon the shelf supporting arm 58 of the adaptor 36. Because the shelf supporting arm 58 is lower in elevation than the recessed horizontal surface 50, the shelf 38 is caused to be inclined or sloped downward from back to front. Advantageously, the adaptor 36 will be as wide, i.e., between the upright 30*a* and 30*b*, as the front crossbeam 32 upon which it rests, thereby utilizing the full width of the shelf 38 as it existed prior to addition of the adaptor 36. If greater slope is desired, the rear cross beam can be raised or the front beam lowered.

While the adaptor cross section can be formed in various sizes to fit the particular crossbeam, an initial production design shown in FIG. 4 has a front wall of about one inch, an upper wall of about 2 ⅛ inches, a vertical wall 60 of 2 ½ inches, a horizontal wall 62 of about ⅞ inch, a rear of about 1 ½ inches, and a support arm of about 1 ¼ inches. The transverse length along the length of the crossbeam may likewise be varied, but the initial design has a length of about four feet.

In addition to obtaining a desired slope to the shelf, the arrangement provides increased vertical storage space. In the prior horizontal shelf arrangement, all of the space directly between the front and rear beams is wasted. However with the new system, the forward edge of the shelf is recessed further into the space and the forward portion of the product container itself is well below the upper surface of the front beam.

I claim:

1. A shelf adaptor which is sized to fit on a notched shelf support and which supports one end of a shelf at an elevation lower than said notched shelf support, comprising:

a bracket portion which is sized to fit upon the upper end of said shelf support; and a shelf supporting portion joined to said bracket portion which is at a lower elevation than said shelf support member.

2. A shelf adaptor which is sized to fit on a notched shelf support and which supports one end of a shelf at an elevation lower than said notched shelf support, comprising:

bracketing means for allowing said adaptor to be placed upon and fit substantially closely against said shelf support; and supporting means, fixed to said bracketing means, which supports a formed end of said shelf at a lower elevation relative to a rear end of said shelf.

3. A shelf adaptor which is sized to fit upon a horizontal shelf support of a standardized shelving unit, comprising:

a front segment;

an upper segment connected to said front segment;

a recessed segment connected to said upper segment and sized to fit substantially closely within a notch of said support member;

a rear segment connected to and depending from said recessed segment; and a shelf supporting arm which extends outwardly from the rear segment to support an end of a shelf.

4. The adaptor of claim 3, wherein said front, upper and recessed segments form an open-ended structure adapted to fit on the upper end of said support.

5. The adaptor of claim 4, wherein said recessed segment includes a vertical portion joined to said upper segment and a horizontal portion which extends between the vertical portion and said rear segment.

6. The adaptor of claim 4, wherein said front segment angles outwardly on its lower end to facilitate positioning said adaptor on the upper end of said support.

7. The adaptor of claim 4, wherein said upper segment extends at an angle upwardly from the upper end of said front segment to the upper end of a vertical portion of said recessed segment.

8. The adaptor of claim 7, wherein said front segment and said upper segment define an angle of about 120° facing said recessed segment, and said upper and recessed segments form an angle of about 65°.

9. The adaptor of claim 4-, wherein said rear segment extends generally vertically and said arm forms an angle of about 85° with said rear segment.

10. A shelf adaptor, comprising a member adapted to fit over the upper end of a generally horizontally extending support and including a series of generally flat interconnected segments, said member extending a considerable distance in the horizontal direction of said support, said segments including a front segment, an upper segment joined to said front segment, a vertical recessed segment connected to said upper segment, a horizontal recessed segment connected at its inner end to the lower end of said vertical segment, a rear segment having its upper edge connected to the outer end of said horizontal recessed segment, and a shelf supporting arm connected to the lower end of said rear segment.

11. The adaptor of claim 10, wherein said forward segment and said upper segment form an angle of approximately 120°, said upper wall and said recessed vertical wall forming an angle of about 65°.

12. The adaptor of claim 11, wherein said rear wall extends generally vertically, and said shelf arm is tilted slightly upwardly so that said rear segment and said shelf support form an angle of about 85°.

13. A method for adapting a shelf in a set of standardized shelving from a substantially horizontal condition to a condition wherein said shelf is angled downward from back to front, comprising the steps of:

placing a display shelf adaptor upon a front shelf support member of said shelving, said adaptor providing a support arm that is spaced below a primary shelf support surface on said member; and placing a front edge of a shelf on said arm, and a rear edge of said shelf on a rear support member about level with said front member surface.

* * * * *